US006564402B1

(12) United States Patent
Lin

(10) Patent No.: US 6,564,402 B1
(45) Date of Patent: May 20, 2003

(54) FOLDABLE BED FRAME DEVICE

(76) Inventor: Chen-Hsiung Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/112,902

(22) Filed: Mar. 29, 2002

(51) Int. Cl.[7] ..... A47C 17/64; A47C 19/14

(52) U.S. Cl. ..... 5/115; 5/182; 5/191; 24/72.5; 297/16.1

(58) Field of Search ..... 5/115, 112, 110, 5/111, 191, 182, 186.1, 174, 176.1, 177, 114; 297/16.1, 16.2, 42, 46; 24/72.5

(56) References Cited

U.S. PATENT DOCUMENTS 540,041 A * 5/1895 Blomberg
1,151,495 A * 8/1915 Menten
6,446,282 B1 * 9/2002 Wu ..... 5/115
6,457,192 B2 * 10/2002 Choi et al. ..... 5/112

* cited by examiner

*Primary Examiner*—Alexander Grosz

(57) ABSTRACT

A foldable bed frame device has a leg support frame, a flexible rectangular net disposed on the leg support frame, and a plurality of elastic fastening buttons. The flexible rectangular net has a plurality of through apertures. The leg support frame has a plurality of leg devices and a plurality of connection rods. Each connection rod is connected to two of the leg devices. Each leg device has a telescopic tube, and a connector disposed on the telescopic tube. Each connector has a round hole to match the corresponding through aperture of the flexible rectangular net. Each elastic fastening button has a click post inserted through the corresponding through aperture of the flexible rectangular net and inserted in the corresponding round hole of the connector.

2 Claims, 5 Drawing Sheets

FOLDABLE BED FRAME DEVICE

BACKGROUND OF THE INVENTION

The present invention relates to a foldable bed frame device. More particularly, the present invention relates to a foldable bed frame device which is easily folded.

A conventional bed frame should be assembled with many fastening members such as bolts, nuts, and rivets. It is difficult for a user to assemble or detach the conventional bed frame.

SUMMARY OF THE INVENTION

An object of the present invention is to provide a foldable bed frame device which is easily folded into a compact configuration.

Accordingly, a foldable bed frame device comprises a leg support frame, a flexible rectangular net disposed on the leg support frame, and a plurality of elastic fastening buttons. The flexible rectangular net has a plurality of through apertures. The leg support frame has a plurality of leg devices and a plurality of connection rods. Each of the connection rods is connected to two of the leg devices. Each of the leg devices has a telescopic tube, and a connector disposed on the telescopic tube. Each connector has a round hole to match the corresponding through aperture of the flexible rectangular net. Each of the elastic fastening buttons has a click post inserted through the corresponding through aperture of the flexible rectangular net and inserted in the corresponding round hole of the connector.

DETAILED DESCRIPTION OF THE INVENTION

Figure 1:
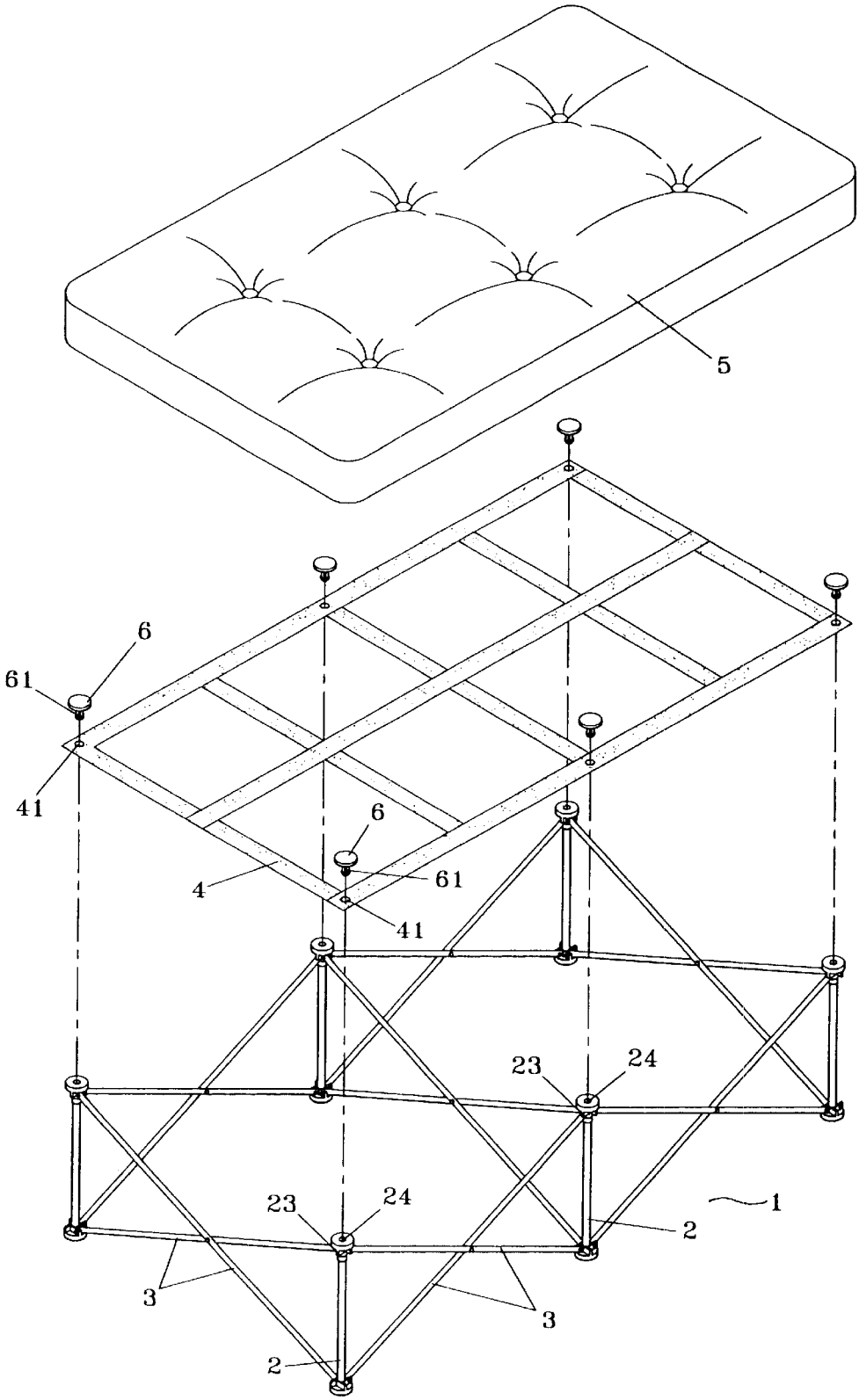
FIG. 1 is a perspective exploded view of a bed pad and a foldable bed frame device of a preferred embodiment in accordance with the present invention.
Figure 2:
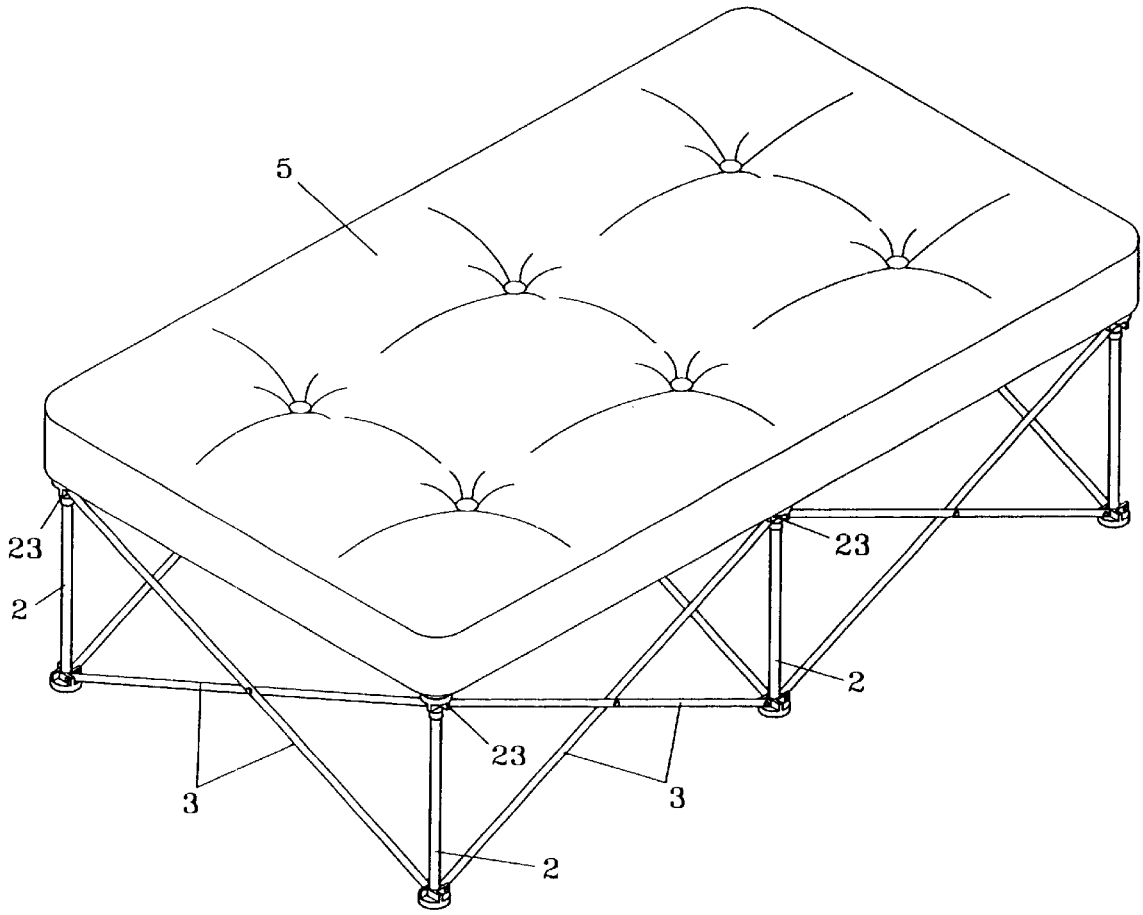
FIG. 2 is a perspective assembly view of a bed pad and a foldable bed frame device of a preferred embodiment in accordance with the present invention.
Figure 3:
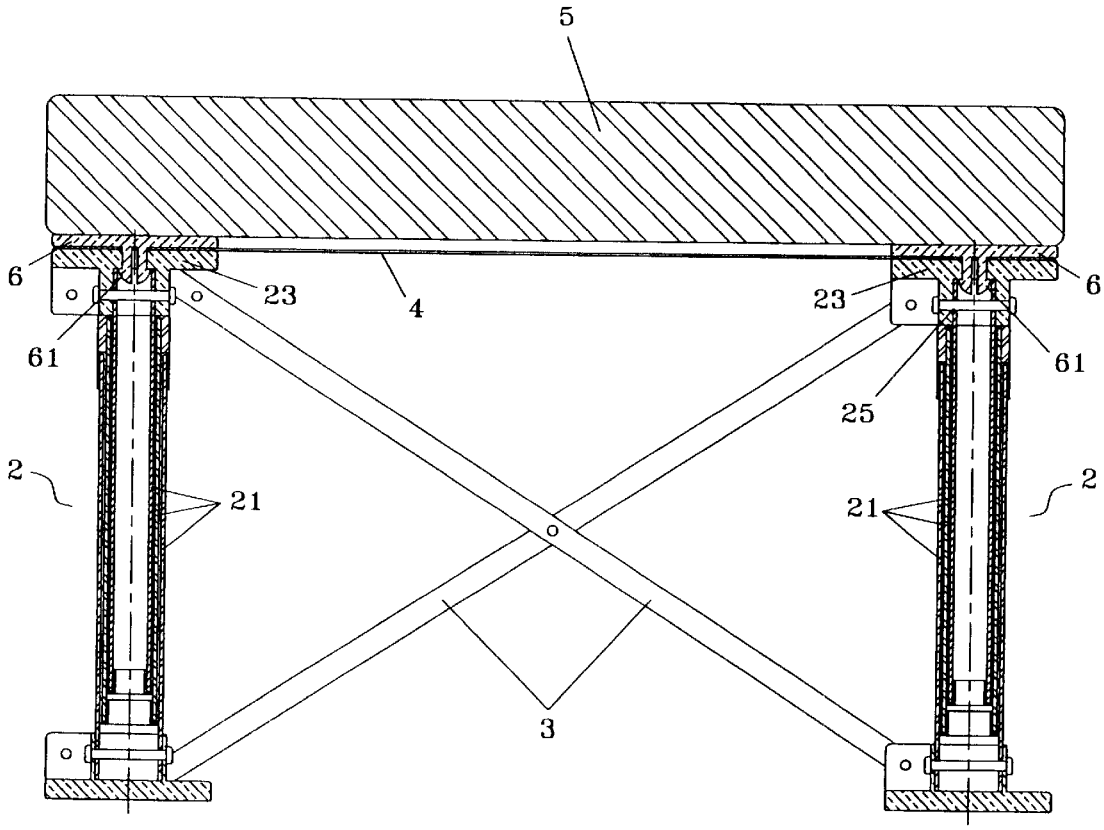
FIG. 3 is a sectional assembly view of a bed pad and a foldable bed frame device of a preferred embodiment in accordance with the present invention.
Figure 4:
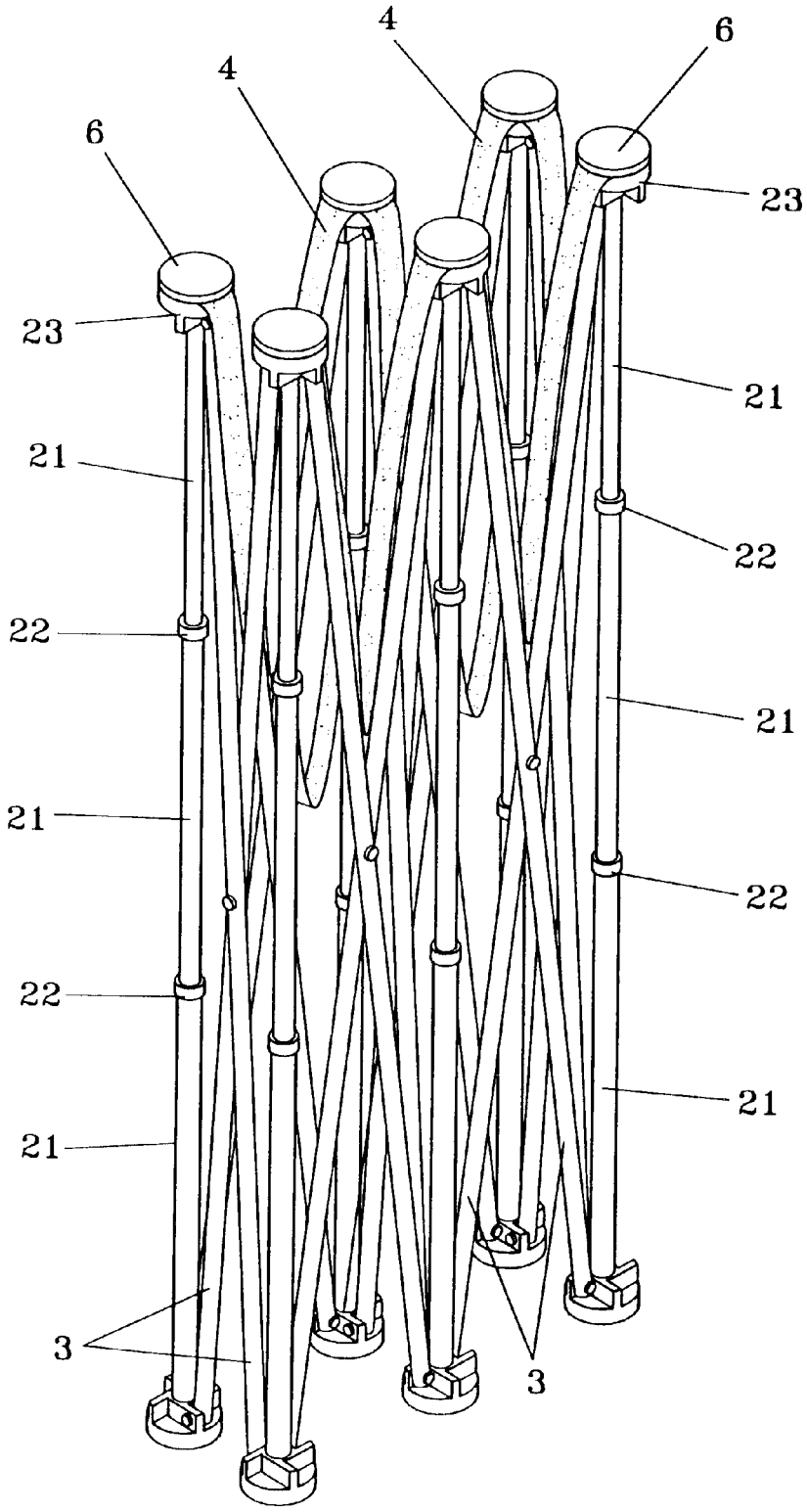
FIG. 4 is a schematic view illustrating a folding of a flexible rectangular frame and a leg support frame of a preferred embodiment in accordance with the present invention.
Figure 5:
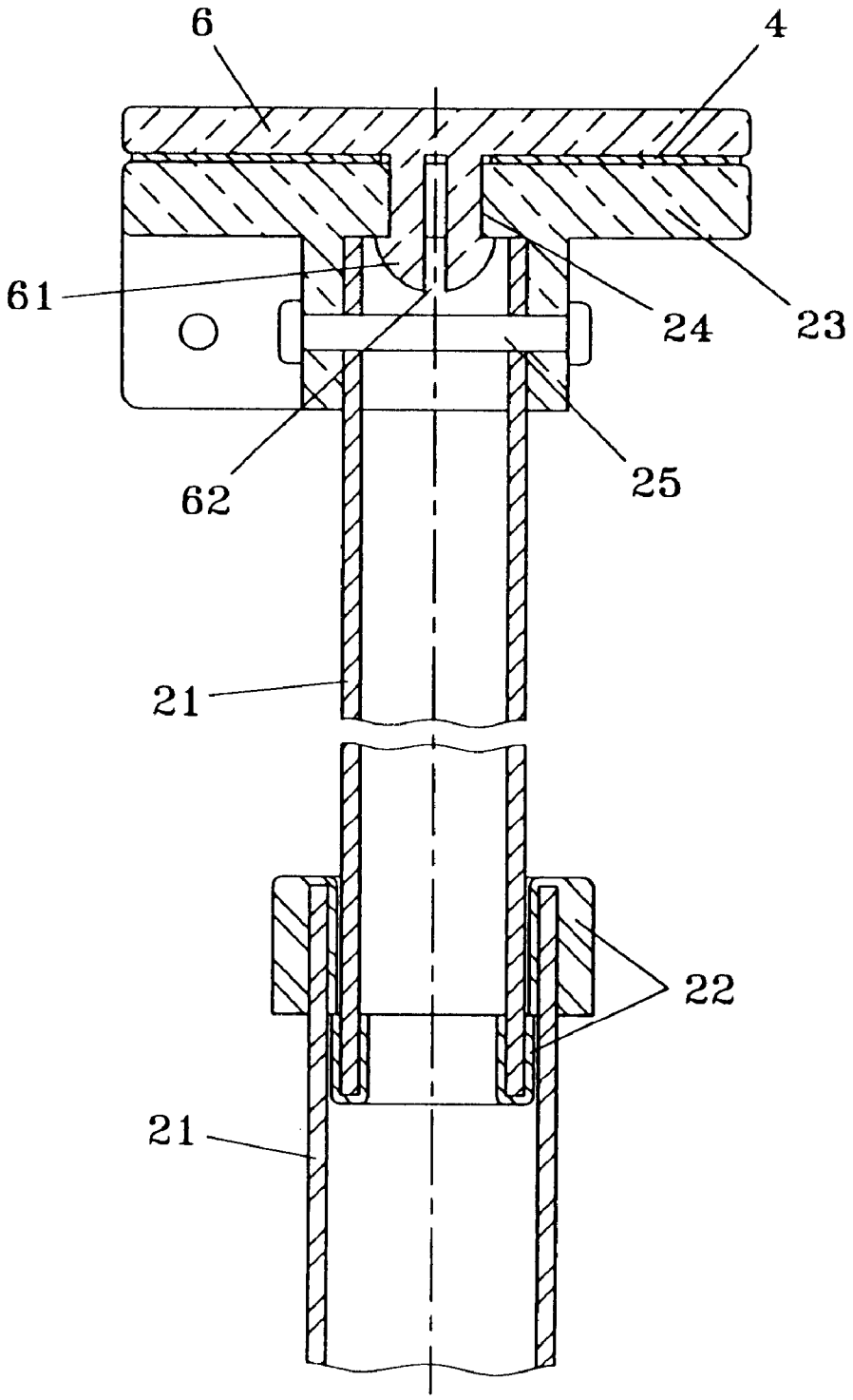
FIG. 5 is a partially sectional view of a leg device while the leg device is folded.

Referring to FIGS. 1 to 5, a foldable bed frame device comprises a leg support frame 1, a flexible rectangular net 4 disposed on the leg support frame 1, and a plurality of elastic fastening buttons 6.

The flexible rectangular net 4 has a plurality of through apertures 41.

The leg support frame 1 has a plurality of leg devices 2 and a plurality of connection rods 3.

Each of the connection rods 3 is connected to two of the leg devices 2.

Each of the leg devices 2 has a telescopic tube 21, a plurality of confining collars 22 surrounding the telescopic tube 21, and a connector 23 disposed on the telescopic tube 21 and fastened by a rivet 25.

Each connector 23 has a round hole 24 to match the corresponding through aperture 41 of the flexible rectangular net 4.

Each of the elastic fastening buttons 6 has a click post 61 inserted through the corresponding through aperture 41 of the flexible rectangular net 4 and inserted in the corresponding round hole 24 of the connector 23.

Each click post 61 has a slot 62.

Referring to FIG. 1 again, the foldable bed frame device is extended.

Referring to FIGS. 4 and 5 again, the foldable bed frame device is folded. The leg support frame 1 and the flexible rectangular net 4 are folded together.

The flexible rectangular net 4 is made of a fabric material.

A bed pad 5 is disposed on the flexible rectangular frame 4.

The invention is not limited to the above embodiment but various modification thereof may be made. Further, various changes in form and detail may be made without departing from the scope of the invention.

I claim:

1. A foldable bed frame device comprises:

a leg support frame, a flexible rectangular net disposed on the leg support frame, and a plurality of elastic fastening buttons, the flexible rectangular net having a plurality of through apertures, the leg support frame having a plurality of leg devices and a plurality of connection rods, each of the connection rods connected to two of the leg devices, each of the leg devices having a telescopic tube, and a connector disposed on the telescopic tube, each said connector having a round hole to match the corresponding through aperture of the flexible rectangular net, and each of the elastic fastening buttons having a click post inserted through the corresponding through aperture of the flexible rectangular net and inserted in the corresponding round hole of the connector.

2. The foldable bed frame device as claimed in claim 1, wherein each of the leg devices further has a plurality of confining collars to surround the telescopic tube.

* * * * *